US006382747B1

(12) United States Patent
Catta et al.

(10) Patent No.: US 6,382,747 B1
(45) Date of Patent: May 7, 2002

(54) CONSOLE SYSTEM WITH SUSPENSION OF EQUIPMENT

(75) Inventors: David Catta; Geoff Gosling; Robert Sirotich; Mac Slipek; Colin Blehm; Steve Van Beveren, all of Alberta (CA)

(73) Assignee: Evans Consoles, Inc., Alberta (CA)

( * ) Notice: Subject to any disclaimer, the term of this patent is extended or adjusted under 35 U.S.C. 154(b) by 0 days.

(21) Appl. No.: 09/323,414

(22) Filed: Jun. 1, 1999

(30) Foreign Application Priority Data

Jun. 2, 1998 (CA) ..... 2239445

(51) Int. Cl.[7] ..... A47B 47/00

(52) U.S. Cl. ..... 312/257.1; 312/265.1; 108/50.02

(58) Field of Search ..... 312/194, 195, 312/196, 223.1, 223.5, 265.1, 265.5, 257.1; 108/50.02, 108; 211/162, 94.01

(56) References Cited

U.S. PATENT DOCUMENTS

| | | | | | |
|---|---|---|---|---|---|
| 1,432,663 | A | * | 10/1922 | Brandts | 312/195 |
| 3,181,923 | A | * | 5/1965 | Guillon et al. | 312/195 |
| 3,770,334 | A | * | 11/1973 | Weber | 312/194 |
| 4,163,537 | A | * | 8/1979 | Mourgue | 312/195 |
| 4,974,913 | A | * | 12/1990 | Vogt et al. | 312/195 |
| 5,046,791 | A | * | 9/1991 | Kooiman | 312/265.1 |
| 5,470,139 | A | * | 11/1995 | Hsiao | 312/265.1 X |
| 5,695,263 | A | * | 12/1997 | Simon et al. | 312/265.1 X |
| 5,715,760 | A | * | 2/1998 | Frascaroli et al. | 108/50.02 X |
| 5,879,070 | A | * | 3/1999 | Severloh | 312/223.5 |
| 5,915,803 | A | * | 6/1999 | Daugherty et al. | 312/265.5 X |

* cited by examiner

*Primary Examiner*—Peter M. Cuomo
*Assistant Examiner*—Michael J. Fisher
(74) *Attorney, Agent, or Firm*—Notaro & Michalos PC

(57) ABSTRACT

There is described a console structure frame for supporting one or more pieces of equipment, comprising a plurality of horizontally spaced vertically upright columns, a beam extending between the columns and equipment supporting members suspended from the beam.

14 Claims, 12 Drawing Sheets

CONSOLE SYSTEM WITH SUSPENSION OF EQUIPMENT

FIELD OF THE INVENTION

The present invention relates to a framework for supporting pieces of work station equipment, and more particularly to a console structure for supporting electronic equipment in the nature of computers, video monitors, control panels and the like.

BACKGROUND OF THE INVENTION

Control consoles of the type described herein generally include a framework for receiving and supporting the necessary pieces of electronic and support equipment including terminals, monitors, keyboards, switchpanels, telephone turrets, lighting and so forth, and a planar work surface extending outwardly from the framework at a convenient height. Some of the equipment including video monitors and output displays is supported to be visible above the work surface for convenient viewing and user access. Attractive finishing panels are also usually supported by the basic framework.

To date, many work station consoles have been custom manufactured which in terms of design and construction is both expensive and time consuming. This approach has been necessitated by customer requirements that are often unique in terms of work station size, equipment placement, human engineering and cost considerations. In the result, the completed console structures are not only extremely expensive, but are also difficult if not impossible to subsequently modify for the reconfiguration of existing equipment or to retrofit new equipment. An alternative approach has been to assemble the consoles from fixed size modular sections. This approach can reduce costs, and although there may be some loss of flexibility with respect to subsequent modifications and reconfigurations of equipment within the console, there are simply many instances in which the cost savings outweigh the advantages of a system critically engineered to permit unlimited post-installation reconfiguration. Some flexibility must however remain.

A need therefore exists for a console structure which overcomes the problems inherent in either the custom design and manufacture or modular assembly of console structures. One such approach has been developed by the Applicant and is described in Canadian Patent 1,291,518 issued Oct. 29, 1991 (equivalent to U.S. Pat. No. 4,836,625).

The backbone of the console structure shown in the aforementioned patents are the horizontally spaced, vertically upright gable members 1 commonly referred to as G-frames. The gables are interconnected by stringers 2 to provide a rigid framework for the console structure. The spacing between gables is infinitely variable so that the framework as a whole is easily adapted to custom requirements both before and after initial on-site assembly. Because most of the equipment in the console is supported by or suspended from the interconnecting stringers, changing the distance between gables is not in and of itself all that disruptive of the system as a whole and particularly the equipment mounting hardware, and this lends the overall structure enormous flexibility. This flexibility comes however at a cost. The gables are metal fabricated usually from tubular steel and are therefore relatively expensive to manufacture and store. The stringers are typically aluminum extrusions and are therefore relatively inexpensive linear stock easily stored, but a lot of different stringers of different shapes and configurations depending upon function are required and an idea of the number and types of stringers needed can be seen from FIGS. 3 to 9 of the patent. This therefore also adds to cost and the need for significant inventory control The need for this number of stringers is made necessary in part because the gables, as aforesaid, are almost entirely structural in function and integrate no channels, interlocks or other mechanical means that increase their versatility or allow them to perform multiple tasks.

The Applicant has found that although there will continue to be a strong demand for the flexibility and retrofit capabilities of its G-frame consoles, and for more modular "discreet logic" systems that cost less, many customers now require accommodation for increasingly large pieces of equipment such as 26 inch monitors and increasingly tall computer towers. To accommodate such items, and to maximize the remaining available space for other pieces of equipment usually mounted below the monitors, it is increasingly desirable to further reduce the number of components making up the console framework. The more vertical and horizontal structural members eliminated, the greater the unimpeded space available for oversized equipment.

SUMMARY OF THE INVENTION

The Applicant has therefore developed a console system which is flexible enough to meet the demands of a custom environment, but wherein the number of components in the system is significantly reduced for cost savings. Many of the remaining components "multi-task", assembly is made easier and less costly, and structural integrity is maintained.

The backbone of the new console structure described below consists of an upper beam extrusion adapted as a point of direct connection or contact for many of the present console's components and from which monitor shelves or cradles can be directly suspended.

It is an object of the present invention therefore to provide a console structure comprising a relatively few basic components which can be easily assembled into a supporting framework for a wide variety of equipment pieces and shapes without major modifications to the basic components themselves.

It is a further object of the present invention to provide a console framework providing as much unimpeded space therein as possible to maximize the adaptability of the framework for the mounting of different pieces of equipment at different locations, and the ability to meet custom requirements using the same basic components.

It is a further object of the present invention to provide a console framework in which equipment can be suspended from an upper structural beam.

According to the present invention then, there is provided a console structure frame for supporting one or more pieces of equipment, comprising a plurality of horizontally spaced vertically upright column members; a beam member extending between said column members; and means for suspending said pieces of equipment said beam member.

BRIEF DESCRIPTION OF THE DRAWINGS

Preferred embodiments of the present invention will now be described in greater detail, and will be better understood when read in conjunction with the following drawings in which.

DETAILED DESCRIPTION

Figure 1:
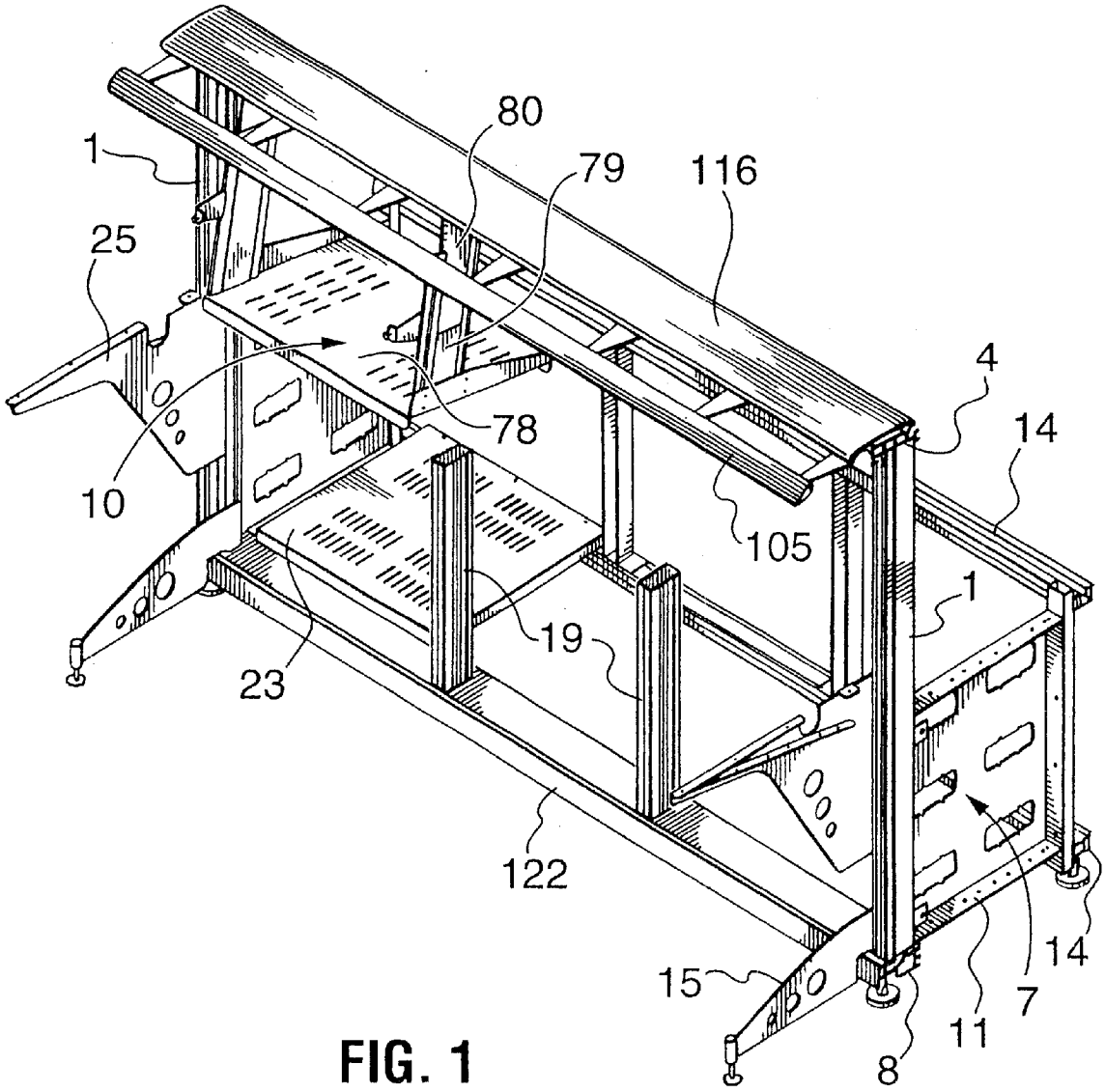
FIG. 1 is a perspective schematical view of the console structure in accordance with one embodiment of the present invention.

With reference to FIG. 1 there is shown a typical console frame in accordance with the present invention adapted to support various pieces of computer hardware, lighting fixtures, other pieces of equipment and finishing panels. Not all consoles of course are adapted nor required to support computers or computer controlled equipment but as this is perhaps the most common use for such consoles, reference will be made to this application by way of example only.

The types of equipment to be supported by the console will vary tremendously. The structure must be adapted to support all these different pieces of equipment, at locations specified by the customer.

Figure 2:
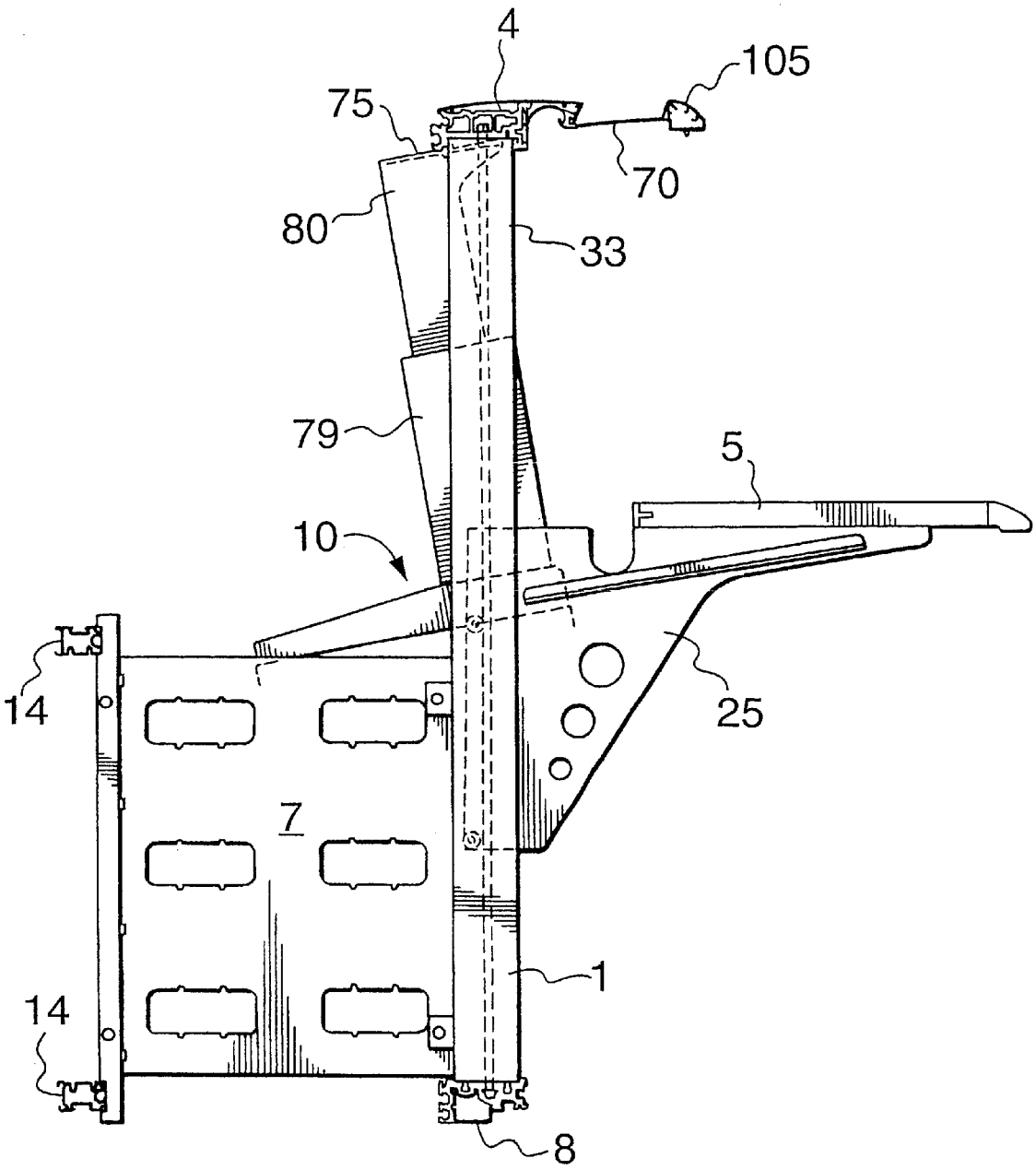
FIG. 2 is a side elevational view of the console of FIG. 1.

With reference to FIGS. 1 and 2, the basic elements of the console structure in accordance with the present invention include a plurality of horizontally spaced, vertically upright columns 1 interconnected at their upper ends by an upper beam 4 and optionally at their lower ends by a lower beam 8. A box frame 7 consisting of rectangular end gables 11 and horizontal stringers 14 make up the rest of the structural framework. As will be described below, upper and lower beams 4 and 8 and columns 1 each perform a variety of functions.

Figure 4:
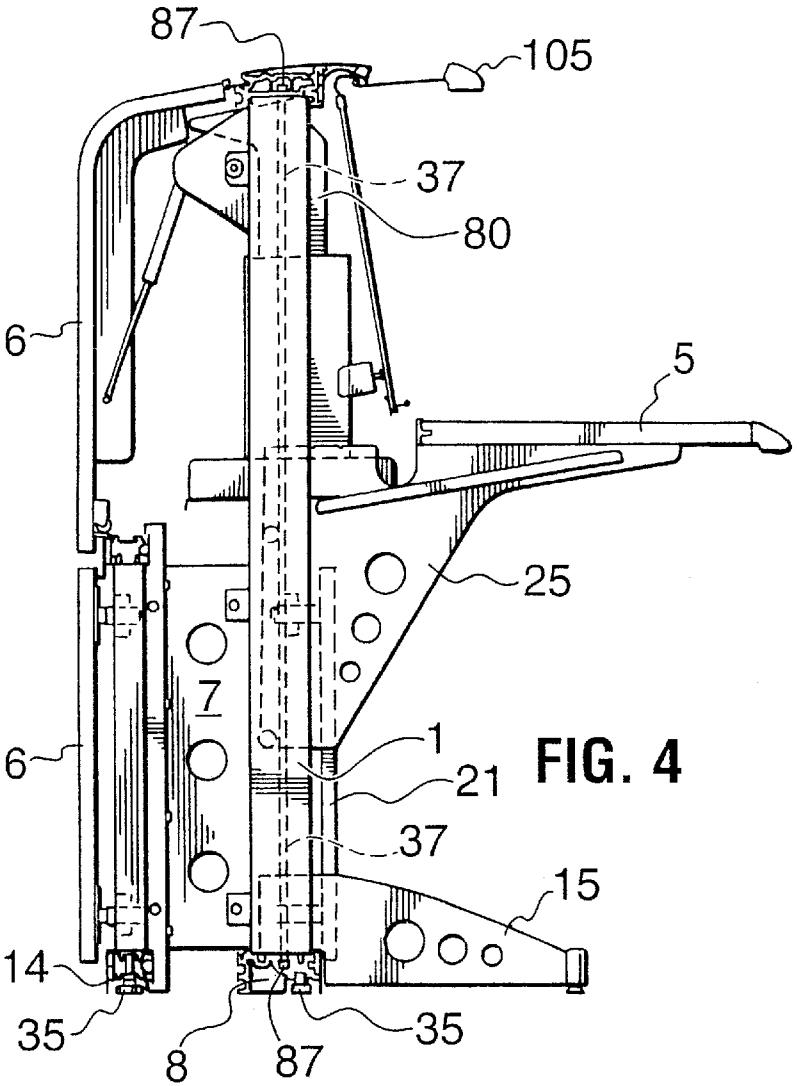
FIG. 4 is a side elevational view of a reduced depth console.
Figure 3:
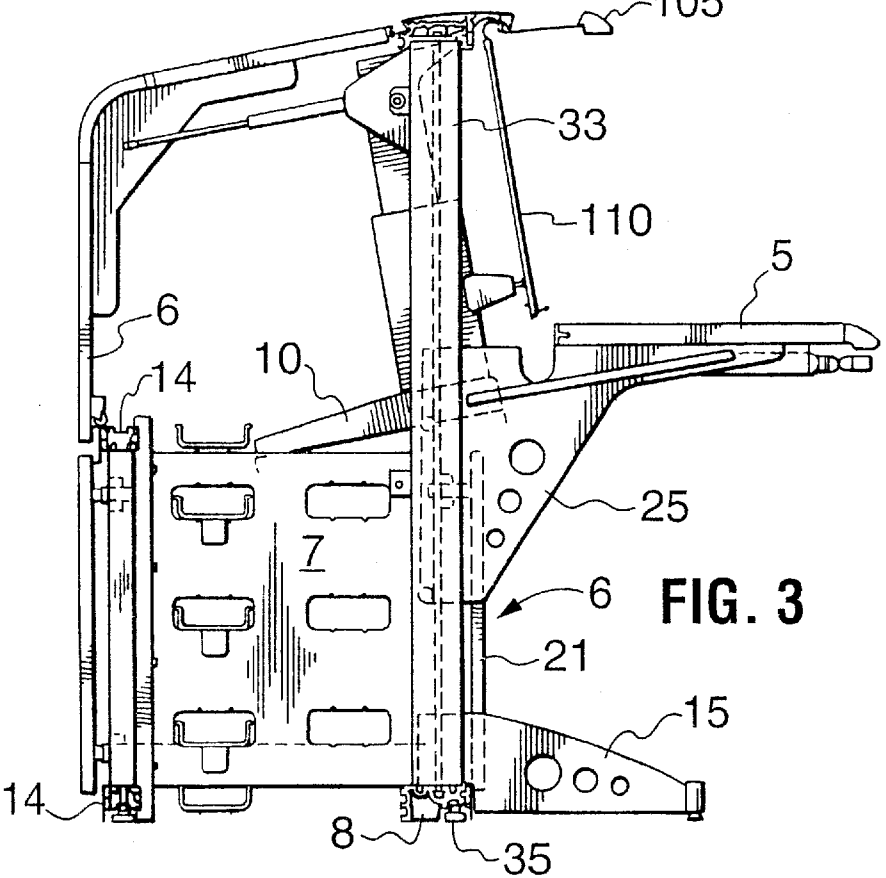
FIG. 3 is a side more detailed elevational view of the console of FIG. 2 with some panels attached.

The console also includes adjustable shelves or cradles 10 for supporting monitors and similar equipment within the console, a horizontal work surface 5 (FIG. 3) and external finishing panels generally indicated at 6 in FIGS. 3 and 4. Lower beam 8 is adapted to support horizontally spaced apart posts 19 that serve as points of connection for cabinet doors 21 as shown most clearly in FIG. 11.

Columns 1 serve as vertically upright, horizontally spaced apart posts. The columns are advantageously linearly extruded aluminum which is easily cut to length depending upon the required height of the console. The columns are interconnected as aforesaid by upper and lower beams 4 and 8 which creates a large unobstructed rectangular front portal into the console framework.

Figure 11:
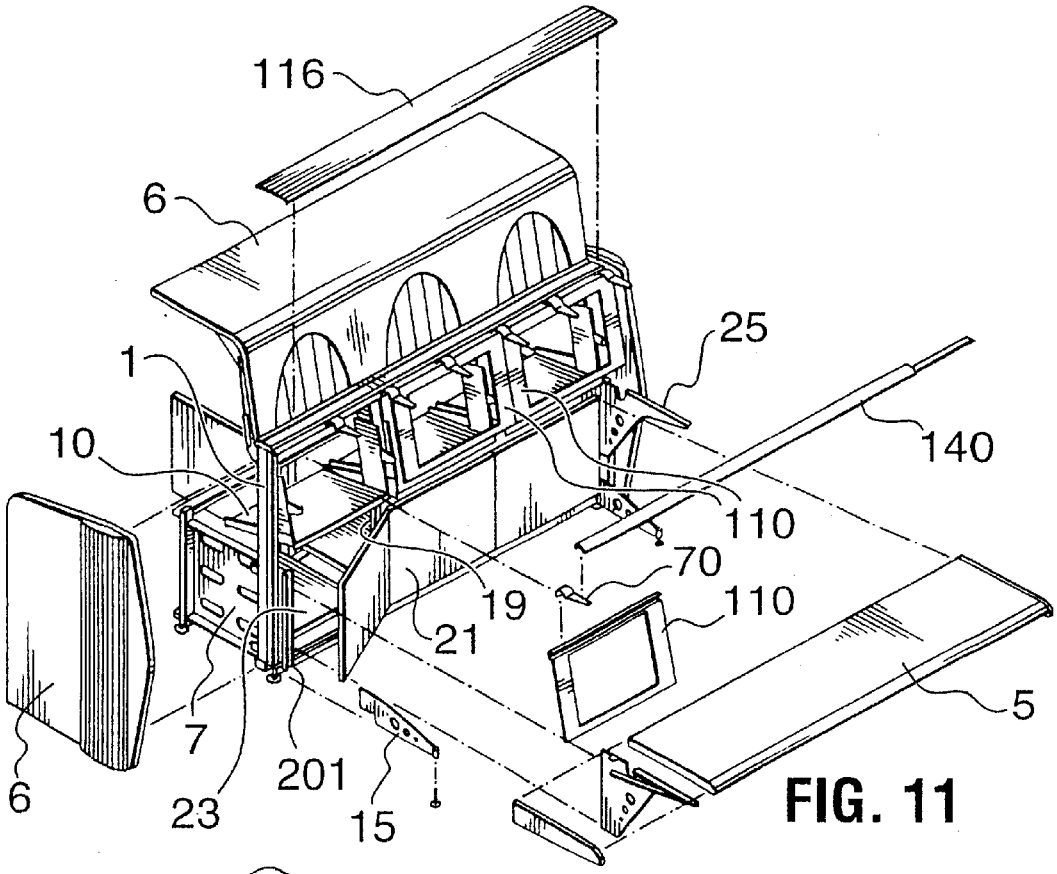
FIG. 11 is a front exploded isometric view of the present console.
Figure 12:
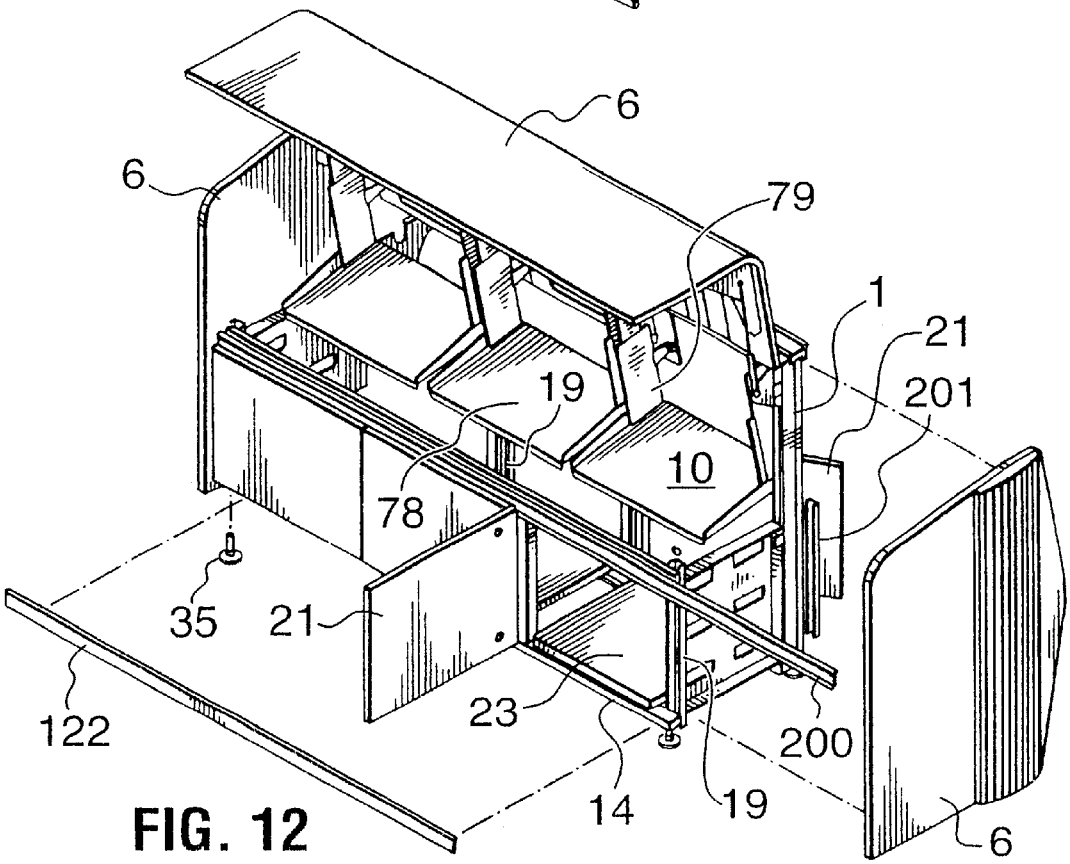
FIG. 12 is a rear exploded isometric view of the console of FIG. 12.

With reference to FIGS. 1 and 2, each column 1 is seen to directly support, from top to bottom, the end of upper beam 4, a horizontal work surface support 25 (which in turn support work surface 5), front panels 21 (FIG. 3) (which can be hinged cabinet-type doors) and the respective end of lower beam 8. The columns can also serve as points of connection for finishing end panels 6 (FIGS. 11 and 12). Lower beam 8 and lower horizontal stringer 14 can be used to support processor shelves 23 (slidable or fixed) again seen most clearly in FIGS. 11 and 12.

Figure 5:
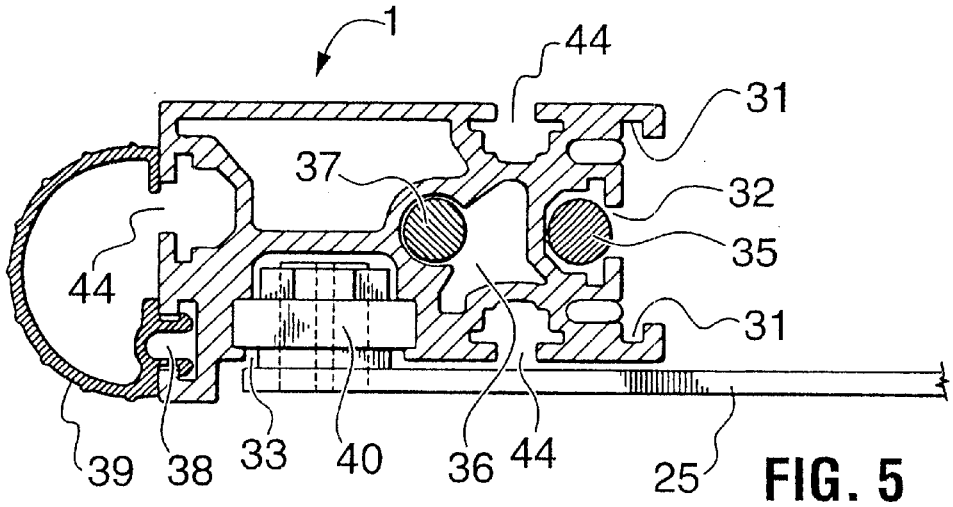
FIG. 5 is a cross-sectional view of the column extrusion.

In a preferred embodiment constructed by the Applicant, the ability of the column to support a variety of other pieces is achieved by forming it with a plurality of longitudinally extending ports, cavities, slots and apertures for connection with various kinds of fasteners, PVC extrusions, bearing, rollers and other kinds of hardware as may be appropriate or needed for connection of other components. Reference is made to FIG. 5 showing an example of a front column extrusion 1 in horizontal cross-section. As mentioned above, the column is advantageously formed by the extrusion of aluminum although other materials and methods of fabrication are available.

As shown, column 1 includes a front slot 31 that can be used to connect the adjustable or fixed work surface brackets 25, a T-slot 32 that can be used to engage the post of a leveller 35 (FIG. 4) or a threaded captive fastener, a central cavity 36 for a column tierod 37 the purpose of which will be described below, a port 38 for cable management clip 39 and a cavity 33 for roller bearings 40 provided on work surface supports 25 that allow the work surface height to be adjusted up and down as required. The work surface is raised and lowered by means of a crank operated lifting mechanism such as that described in Applicant's Canadian patent No. 2,100,421 filed Jul. 13, 1993.

Figure 8:
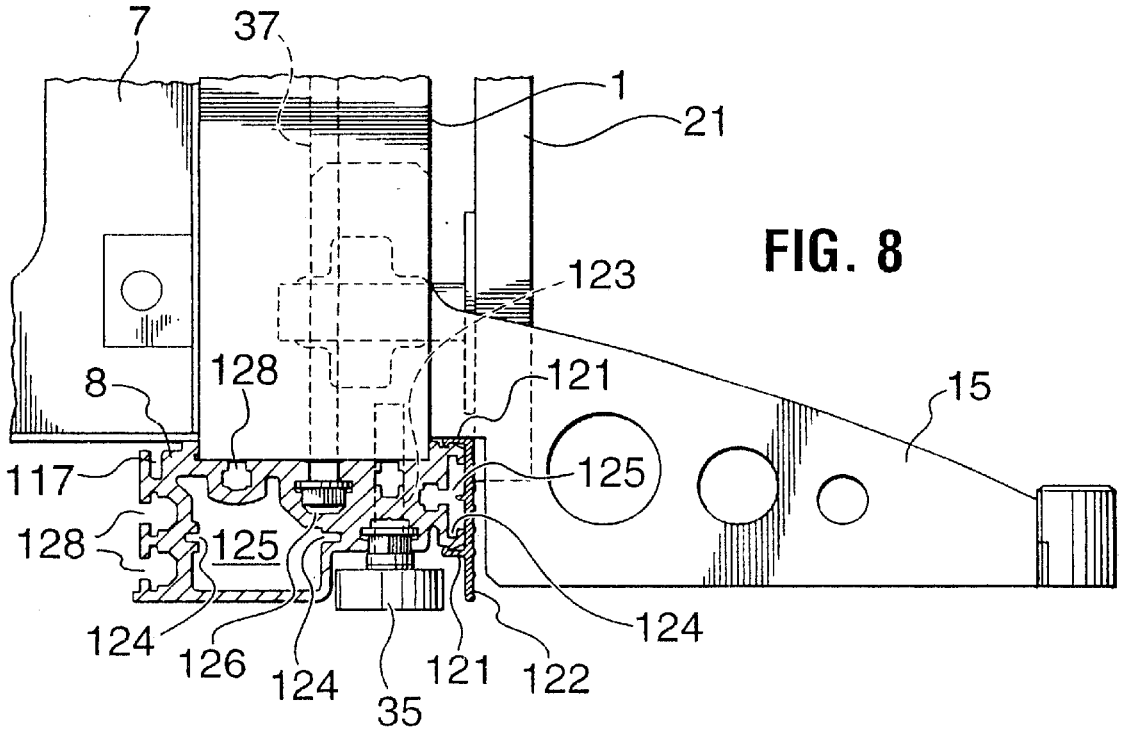
FIG. 8 is a cross-sectional view of the lower beam.

Column 1 also includes some additional T-slots 44 adapted to receive standard square or hex nuts for connection to threaded fasteners to mount or attach other components like stringers, hinges for doors 21, clips, mounting brackets, hooks for supporting finishing panels or anything else specified by the customer, including support feet 15 shown attached to column 1 in FIGS. 3, 4 and 8.

Figure 21:
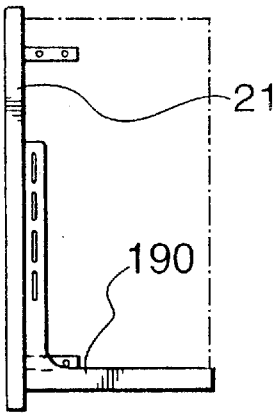
FIG. 21 is a side elevational view of a door mounted processor shelf.
Figure 22:
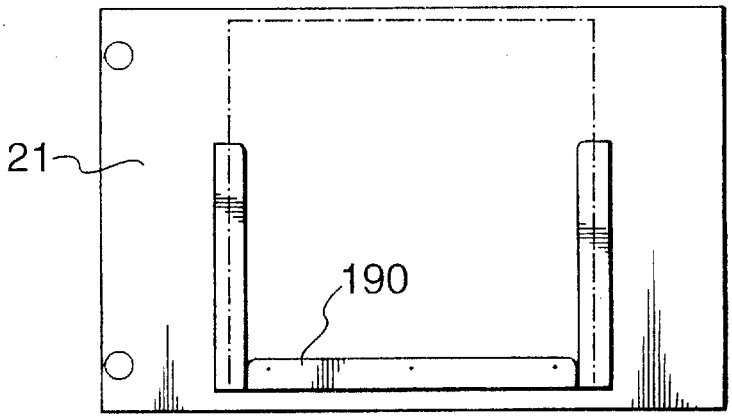
FIG. 22 is a front elevational view of the shelf of FIG. 21.

Reference is now made to FIG. 8 showing an example of extruded lower beam 8 in cross-section. The lower beam includes a pair of bevelled shoulders 121 for a snap-fit connection to a baseboard 122, an aperture 123 for leveller 35, slots 124 for splines (not shown) that can be used to connect adjacent lower beams together, a cavity 126 for the lower end of tierod 37 and some additional T-slots 128 for cable management clips and for various nuts and other hardware useful to connect or attach other parts shown in the detailed views of FIGS. 3 and 4 that are more representative of the present full and reduced depth consoles as actually constructed. A longitudinally extending ribbed or threaded recess 117 is provided for fasteners and the like used to connect processor shelves 23, rack mounts and so forth. Reduced depth consoles as shown in FIG. 4 offer space saving advantages particularly if flat screen monitors are used in place of full depth CRT displays, In this embodiment, the processor (shown in broken line) will typically be supported on shelves 190 (FIGS. 21 and 22) mounted directly onto doors 21 so that when the door is opened, the processor's front face including the power switch and the slots for discs and CD-ROMS will face outwardly towards the user.

Figure 23:
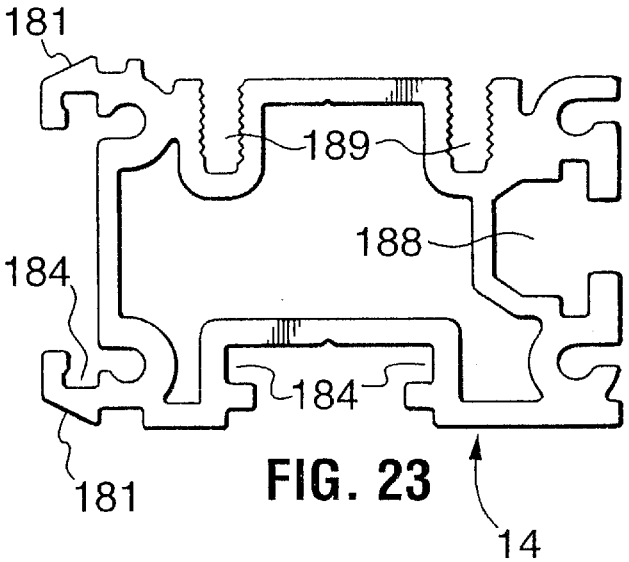
FIG. 23 is a side elevational view of the lower rear stringer.

Lower rear stringer 14 is shown in detail in the cross-sectional view of FIG. 23. The stringer includes a pair of bevelled shoulders 181 for a snap fit connection to a baseboard 122, slots 184 for splines or other sheet metal connectors (neither shown) that can be used to connect adjacent stringers together, a T-slot 188 for various nuts or other hardware to connect or attach other parts such as structural frame components like end gables 7 and longitudinally extending ribbed recesses 189 (screw ports) to receive fasteners for connecting processor shelves 23 and other pieces of equipment.

Figure 6:
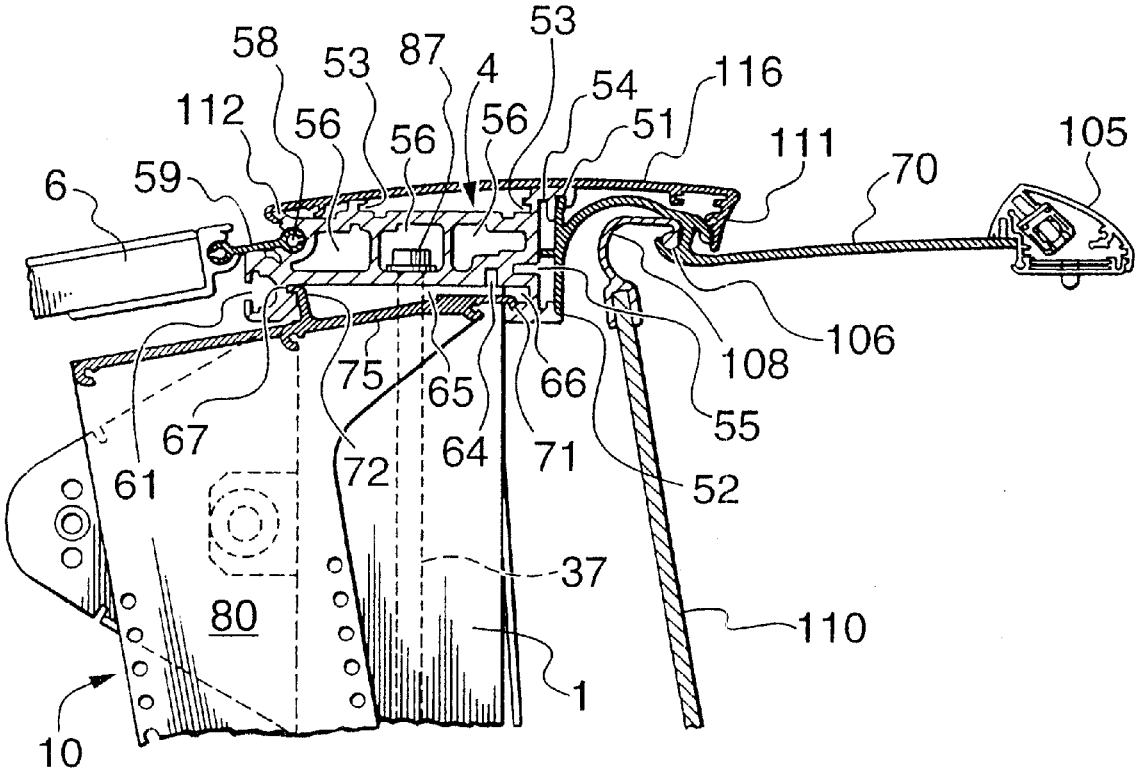
FIG. 6 is an enlarged cross-sectional view of the upper beam with some additional components connected thereto.
Figure 7:
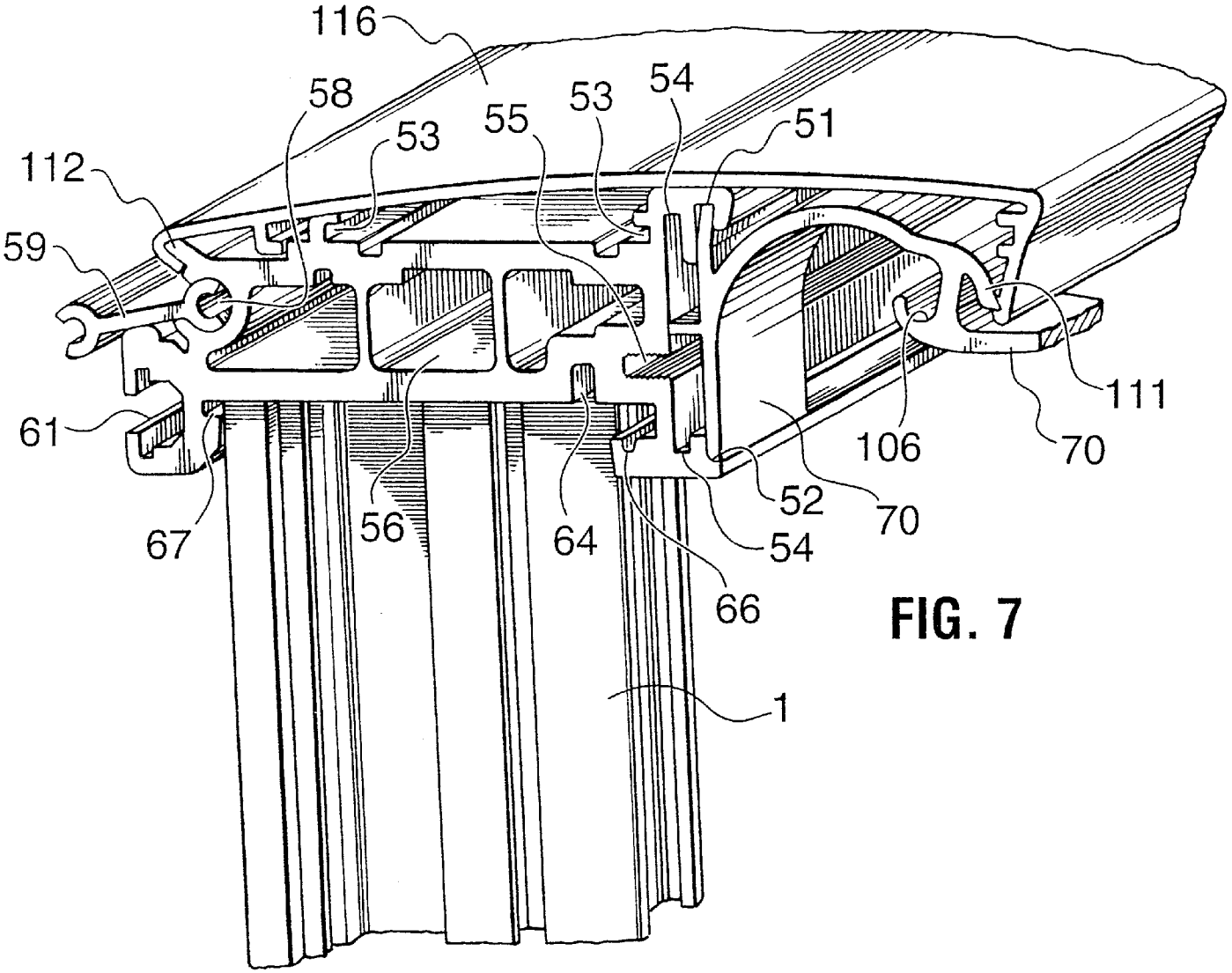
FIG. 7 is a perspective view of the beam shown in FIG. 6.

Reference will now be made to FIGS. 6 and 7 showing upper beam 4 in cross-section. This beam as well is advantageously an aluminum extrusion.

As shown, upper beam 4 includes a front notch 51 and cooperating shoulder 52 for a leveraged connection to task light arm 70, a slot 54 with a grooved channel 55 that can be used for the connection of splines (not shown) that in turn are used to connect adjacent beams 4 together, some central cavities 56, one of which receives the upper end of column tierod 37 and a circular cavity 58 for a hinge 59 that connects to pivotable back panel 6. An additional port 61 is provided that can be used for flanged nuts, cable management clips or other hardware that might be needed at this spot. An additional slot 53 is provided for a spline used to connect adjacent beams at corner sections.

The lower surface of beam 4 includes a slot 65 including a forward portion 66 and a rearward portion 67. There is also a notch 64 that allows for the connection of a work surface bracket without any fastener. Slot 65 is used to connect with a monitor cradle hanger extrusion 75 as will now be described in greater detail.

The Applicant has found that by literally suspending the monitor cradles from upper beam 4, much of the structural framework normally used to mount the monitors can be eliminated, particularly cross-members, horizontal stringers and fixed shelves. This in turn opens up much of the console's interior and frees it of obstructions that would otherwise impede the installation particularly of oversized monitors and extra tall processor towers. The monitors themselves are directly supported on monitor cradles 10.

As will be appreciated by those skilled in the art, there are numerous ways in which the cradles can be hung from the upper beam and the following description should therefore be regarded as exemplary only.

Figure 9:
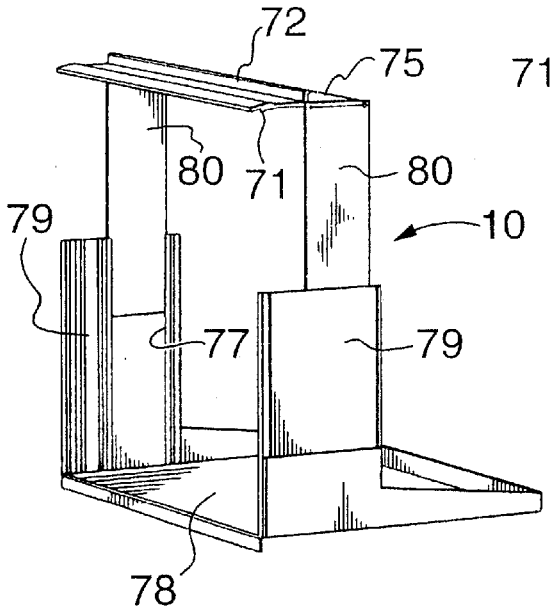
FIG. 9 is a perspective view of the monitor cradle.
Figure 10:
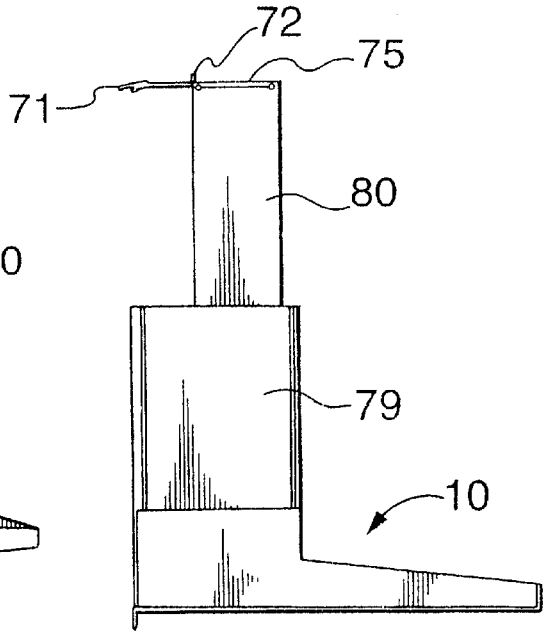
FIG. 10 is a side elevational view of the cradle of FIG. 9.

With reference initially to FIGS. 9 and 10, monitor cradles 10 consist of a shelf portion 78, sides 79 and columns 80 slidably received into slots 77 formed into each of sides 79. The positioning of columns 80 relative to sides 79 is adjustable by means of a ratchet mechanism, set screws or any other suitable mechanism so that the height of the cradle can be adjusted to accommodate monitors of different sizes. Spanning the upper ends of columns 80 is the cradle hanger extrusion 75 which includes a front hook 71 and a rear hook 72. As best seen from FIG. 6, front hook 71 engages forward portion 66 and rear hook 72 engages the rearward portion 67 of the slot 65 in the upper beam. This results in the suspension of the cradle at a predetermined angle to the vertical as shown in the drawings, the angle being chosen to facilitate viewing of the monitor supported on the cradle by a user sitting or standing in front of the console.

Figure 14:
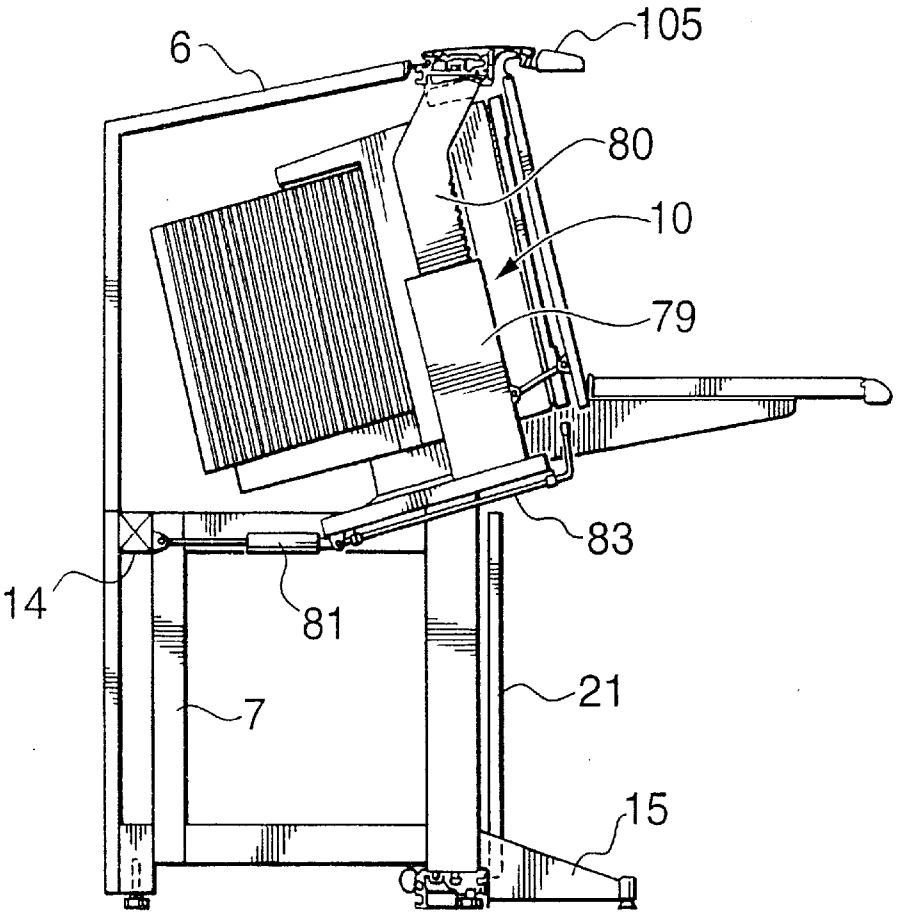
FIG. 14 is a side elevational view of the console of FIG. 13 in a pivotal position.
Figure 13:
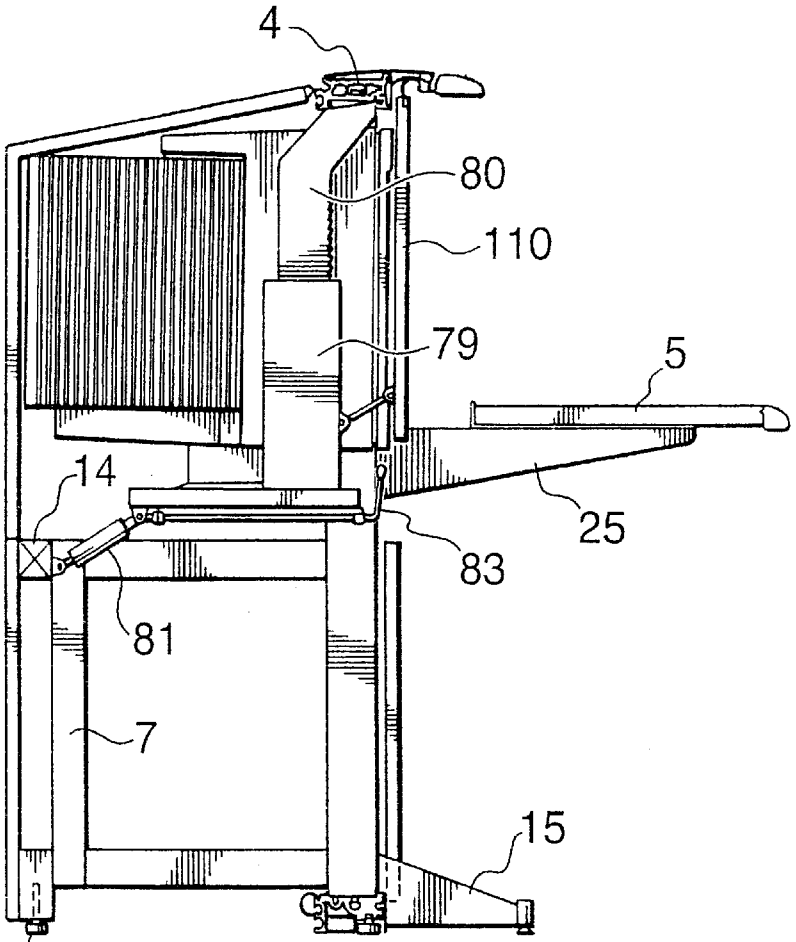
FIG. 13 is a side elevational view of the console displaying a pivotable monitor cradle mount.

In the example just described, the angle at which the cradle is suspended is fixed. If desired, an adjustable pivotable mount can be provided, an example of which is shown in FIGS. 13 and 14. More specifically, cradle 10 is pivotally suspended from upper beam 4 for pivotable movement between the positions shown in FIGS. 13 and 14 and of course any position in between. One means of controlling and adjusting the degree of tilt is by means of a gas cylinder 81 connected between frame 7 or stringer 14 and cradle 10 as shown. A control lever 83 extends forwardly from the gas piston to be accessible from the front of the console and is used to activate the piston to tilt the monitor back and forth as required.

Figure 16:
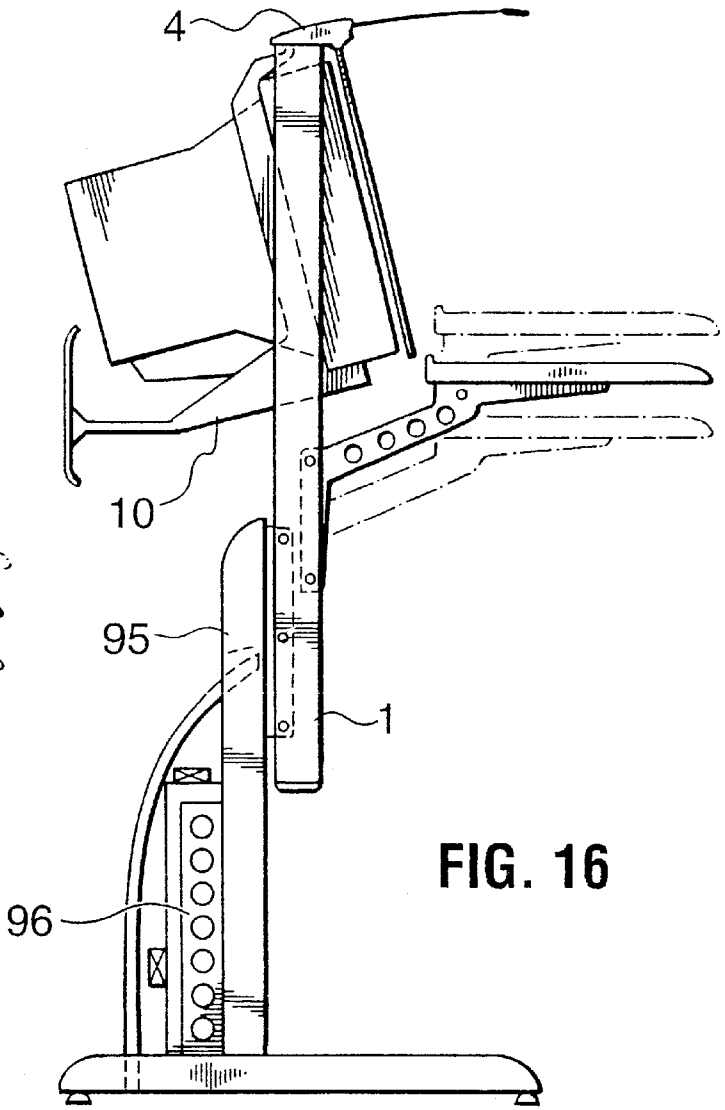
FIG. 16 is a side elevational view of the console of FIG. 15 in a raised position.
Figure 15:
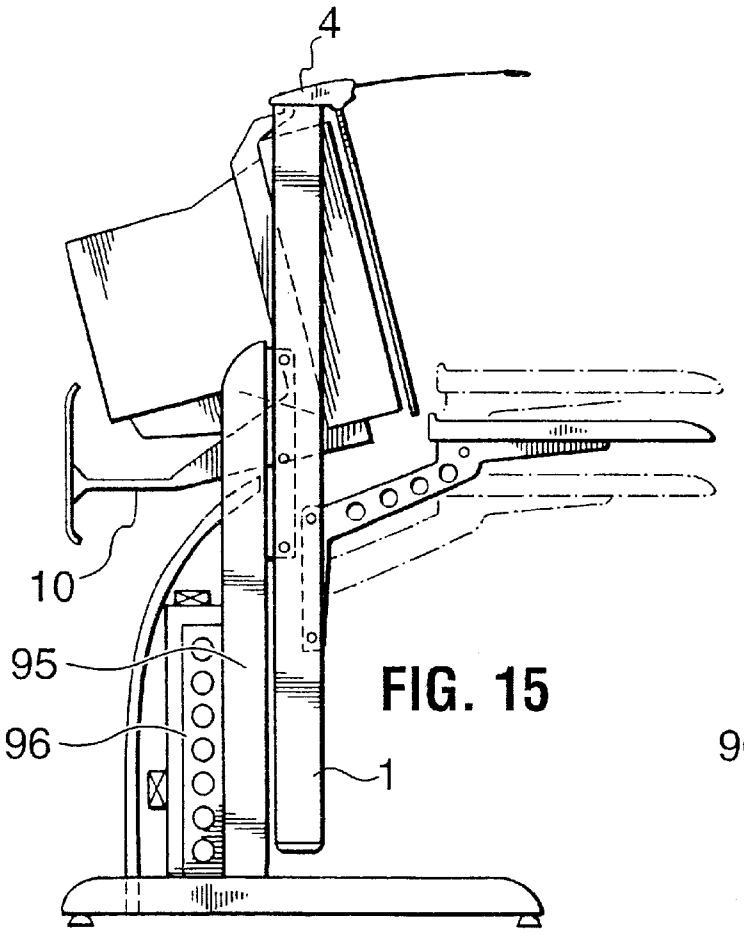
FIG. 15 is a side elevational view of a vertically adjustable console in a lowered position.

It is further contemplated that the vertical height of the entire console structure can be made adjustable such as by means of an arrangement such as shown in FIGS. 15 and 16. Generally, columns 1 are mechanically mated to pillars 95 including an electrical, hydraulic or pneumatic drive 96 selectively actuatable to raise or lower the columns. The nature of the drive mechanism will be readily apparent to those skilled in the art and a detailed description thereof is therefore omitted.

With reference once again to FIGS. 4 and 6, additional rigidity in the console framework can be obtained by compressive loading of columns 1 between upper beam 4 and lower beam 8. This can be accomplished by means of tierod 37 extending between the upper and lower beams through the column with the loading being applied by nuts 87 tightened onto the rod's opposite ends as shown. This same mechanism can be used to connect posts 19 to lower beam 8.

With reference once again to FIGS. 6 and 7, task light arm 70 essentially cantilevers off upper beam 4. The primary purpose of the arm is to house task light 105 which throws illumination onto work surface 5. The arm additionally includes a longitudinal groove 106 that serves as the point of suspension for equipment front hooks 108 used to hold the equipment front panels 110 in place over the monitor screens as best seen from FIG. 11. The task light arm also includes a lip 111 that cooperates with another lip 112 on the rearward edge of the upper beam so that a finishing cap 116 can be snap fit into place, concealing the upper beam and part of the task light arm.

Figure 17:
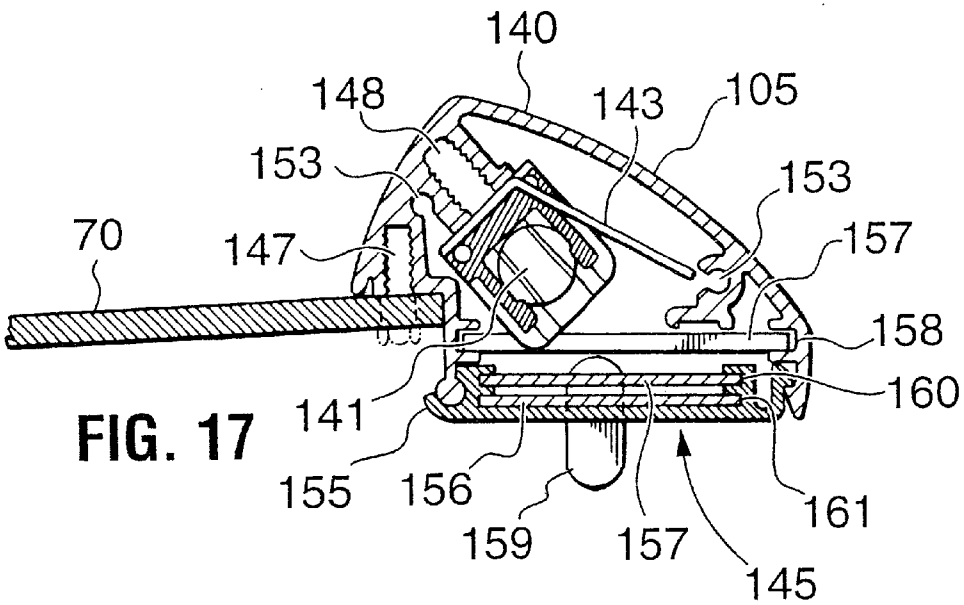
FIG. 17 is a side elevational cross-sectional view of the task light.
Figure 18:
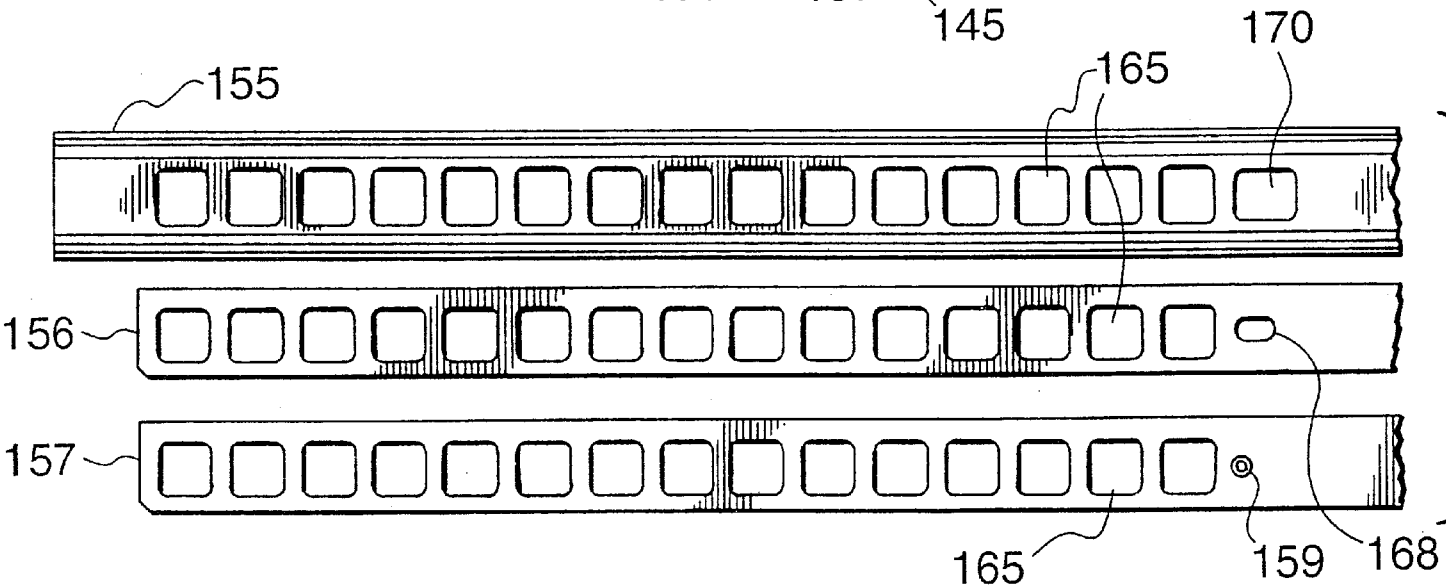
FIG. 18 is a plan view of the light baffles and baffle guide of the task light of FIG. 18.
Figure 19:
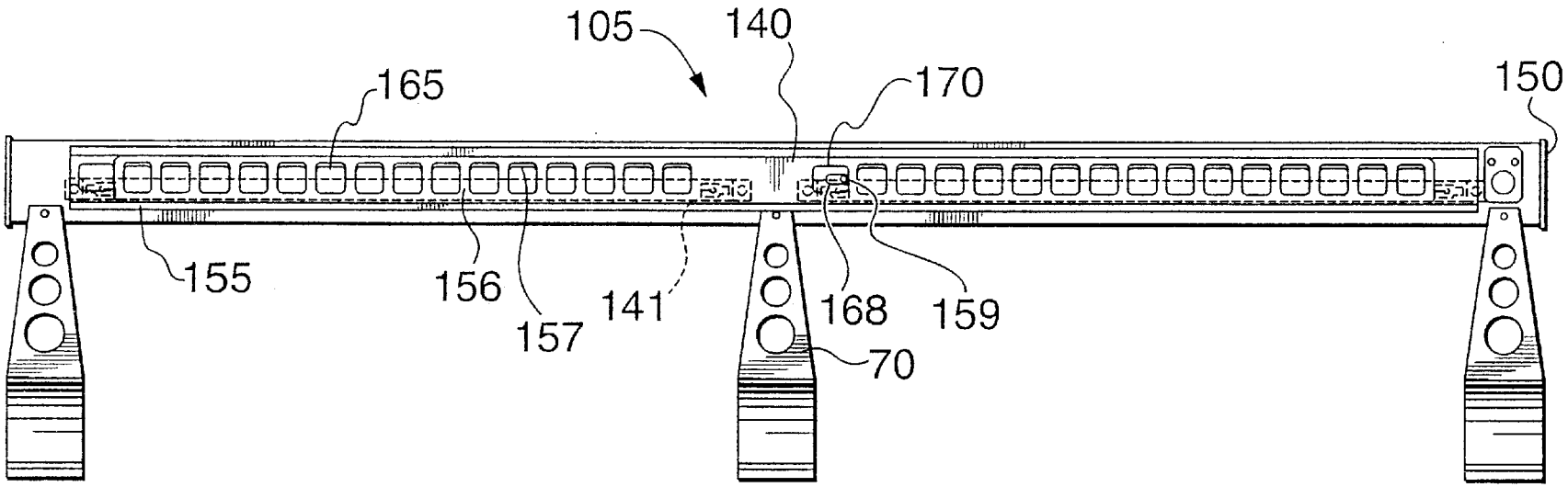
FIG. 19 is a bottom plan view of the task light.

Task light 105 is shown in greater detail in FIGS. 17, 18 and 19. The light includes a longitudinally extending housing 140 that encloses a fluorescent light socket and bulb 141, a reflector plate 143 and a mechanical dimming mechanism 145. Housing 140 is advantageously an aluminum extrusion that can be formed in any required length and that is connected to supporting arms 70 by bolts that thread into ribbed longitudinally extending slot 147 in the housing. Reflector plate 143 is typically a piece of steel or other metal finished in baked white enamel that connects to the housing 140 by means of bolts that thread into longitudinally extending ribbed recess 148 in the housing. The length of the reflector will generally be the same as the length of light bulb and socket 141 with the socket being connected to the reflector by means of self tapping screws, threaded fasteners or the like. The ends of the housing are finished and closed by side supports 150 connected to the housing by screws or other suitable fasteners that thread into longitudinally extending holes 153 in the housing. A spline 157 in slot 158 can be used to connect lengths of housing 140 together and at corner sections.

Dimming mechanism 145 consists of a baffle guide 155, lower light baffle 156, an upper slidable baffle 157 and a slider knob 159 bolted or screwed to the upper baffle. Baffle guide 155 is typically a PVC extrusion that hingedly snap fits to housing 140 as best seen in FIG. 17. The guide includes upper longitudinally extending opposed slots 160 to slidably receive upper baffle 157 therein and lower longitudinally extending opposed slots 161 to slidably receive lower baffle 156 therein. As seen best from FIG. 19, baffle guide 155 and upper and lower baffles 156 and 157 are each formed with a plurality of openings 165 for the passage of light. Slider knob 159 is connected to the upper baffle as shown and passes through a slot 168 in the lower baffle and a slightly elongated opening 170 in the baffle guide 155 so that the knob can be used to move upper baffle 157 back and forth relative to the lower baffle to regulate the amount of light that can escape the task light housing. This system is generally less expensive, simpler and more reliable than conventional electronic dimmer controls. It also provides higher quality light at various dimming intervals.

Figure 20:
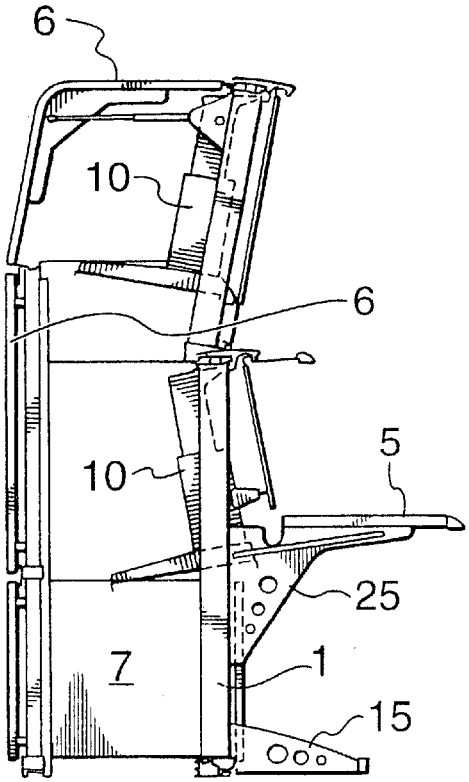
FIG. 20 is a side elevational view of a double height console.

It is sometimes required that there be two or more rows of monitors one on top of the other. The present console can be adapted for this purpose as shown in FIG. 20.

Finishing panels 6 can be applied to the console framework in any known manner to complete the structure's finished appearance. The finishing panels can include reveals 200 and fillers 201 (FIGS. 11 and 12) to decoratively cover exposed surfaces of the various stringers, extrusions and columns making up the present framework.

Although preferred embodiments of the invention have been described in considerable detail for illustrative purposes, many modifications will occur to those skilled in the art without departing from the inventive scope of the present invention which is limited only by the true scope of the appended claims.

What is claimed is:

1. A console structure frame for supporting one or more pieces of equipment, comprising:

a plurality of horizontally spaced vertically upright members;

a beam member extending between said upright members; and cradle means for supporting selected ones of said pieces of equipment thereon, said cradle means having hook means thereon for releasable connection to cooperating hook receiving grooves in said beam member wherein said cradle means hang from said beam member, said beam member including a longitudinally extending slot formed in a lower surface thereof, said cooperating hook receiving grooves being formed on opposite lateral sides of said slot to open towards each other.

2. The console structure of claim 1 wherein said cradle means comprise a horizontal member having said hook means thereon, side members depending downwardly from said horizontal member and a shelf member extending between said side members.

3. The console structure of claim 2 wherein said side members are adjustable in length.

4. The console structure of claim 3 including support members for supporting a work surface, said support members being adapted for respective connection to said upright members.

5. The console structure of claim 4 wherein said support members are vertically adjustable on said column members.

6. The console structure of claim 1 including a task light supported from said beam member, said task light including at least two baffle means each having apertures formed therethrough for the passage of light, one of said baffle means being movable relative to the other for varying the amount of light emitted from said task light.

7. The console structure of claim 1 including door members hingedly connected thereto, said door members having shelves thereon moveable with said door members for supporting a piece of equipment.

8. A console structure frame for supporting one or more pieces of equipment, comprising:

a plurality of horizontally spaced vertically upright members;

a beam member extending between said upright members; and cradle means for supporting selected ones of said pieces of equipment on a shelf forming part of said cradle, said cradle means having hook means thereon for a non-clamped releasable connection to cooperating hook receiving grooves in said beam member wherein said cradle means hang from said beam member;

said beam member including a longitudinally extending slot formed in a lower surface thereof, said cooperating hook receiving grooves being formed on opposite lateral sides of said slot to open towards each other.

9. The console structure of claim 8 wherein said cradle means comprise a horizontal member having said hook means thereon, side members depending downwardly from said horizontal member and said shelf member extending between said side members.

10. The console structure of claim 9 wherein said side members are adjustable in length.

11. The console structure of claim 10 including support members for supporting a work surface, said support members being adapted for respective connection to said upright members.

12. The console structure of claim 11 wherein said support members are vertically adjustable on said column members.

13. The console structure of claim 8 including a task light supported from said beam member, said task light including at least two baffle means each having apertures formed therethrough for the passage of light, one of said baffle means being movable relative to the other for varying the amount of light emitted from said task light.

14. The console structure of claim 8 including door members hingedly connected thereto, said door members having shelves thereon moveable with said door members for supporting a piece of equipment.

* * * * *